United States Patent [19]

Ishikawa et al.

[11] 4,135,994

[45] Jan. 23, 1979

[54] PROCESS FOR ELECTROLYTICALLY PRODUCING ALUMINUM

[75] Inventors: Tatsuo Ishikawa, Sapporo; Hachiro Ichikawa, Shimizu, both of Japan

[73] Assignee: Nippon Light Metal Company Limited, Tokyo, Japan

[21] Appl. No.: 851,632

[22] Filed: Nov. 15, 1977

[51] Int. Cl.[2] ..... C25C 3/06

[52] U.S. Cl. ..... 204/67

[58] Field of Search ..... 204/67

[56] References Cited

U.S. PATENT DOCUMENTS 3,822,195 7/1974 Dell et al. ..... 204/67

*Primary Examiner*—Howard S. Williams

*Attorney, Agent, or Firm*—William J. Daniel

[57] ABSTRACT

A process for producing aluminum by electrolyzing fused aluminum chloride together with an alkali metal halide to produce chlorine gas at the anode surface and molten aluminum at the cathode surface where the electrolytic bath is of a molten mixed salt consisting essentially of 2 to 15% by weight $AlCl_3$, 15 to 70% by weight $CaCl_2$ and/or $MgCl_2$, provided the amount of $CaCl_2$ does not exceed 40% by weight, and 83 to 15% by weight NaCl. Metallic aluminum can be produced by electrolyzing aluminum chloride at a high current efficiency reaching about 90 to nearly 100%.

9 Claims, No Drawings

PROCESS FOR ELECTROLYTICALLY PRODUCING ALUMINUM

BACKGROUND OF THE INVENTION

1. Field of the Invention

This invention relates to a process for industrially advantageously producing aluminum by electrolyzing aluminum chloride in molten salt.

2. Description of the Prior Art

Aluminum has been heretofore produced by a so-called Hall-Heroult process wherein aluminum oxide (alumina) is dissolved in an elecyrolytic bath of a metal fluoride molten salt consisting predominantly of molten cryolite and is electrolyzed in the electrolytic cell. However, in the Hall-Heroult process, in principle, such large amounts of electric energy are required to electrolytically reduce alumina that, in fact, the electric power required to produce one ton of aluminum is 15,000kwh or more; therefore, the development of a process for producing aluminum with reduced electric energy consumption is highly desirable.

As a prospective energy saving aluminum producing process to take the place of the Hall-Heroult process, there is known an aluminum chloride electrolyzing process wherein aluminum chloride is dissolved in a molten salt bath of alkali metal chloride such as NaCl or KCl (sometimes accompanied by small additions of alkaline earth metal chloride) and is electrolyzed. Although this aluminum chloride melting electrolyzing process has definite advantages in that it can be operated at an electrolyzing temperature of about 700° C., which is about 300° C. lower than in the Hall-Heroult process, and in that, as the anodic reaction releases chlorine, the graphite electrode used for the anode will not be consumed, it has been long ignored in the industry for the reasons that it is troublesome to handle aluminum chloride and chorine gas at high temperatures and that no adequate bath-resistant material was industrially available. However, an aluminum chloride electrolyzing process (the so-called ALCOA process) employing a new electrolyzing apparatus and an electrolytic bath having new composition has been recently suggested by ALCOA (Aluminum Company of America), U.S.A. (U.S. Pat. No. 3,822,195) and has quickly received industrial attention.

In this ALCOA process, the electrolysis is carried out at a bath temperature of about 700° C., an electrode distance of about 15mm and a current density of about 1 ampere/cm$^2$ in an electrolytic bath composed of a molten salt of an $AlCl_3$ — LiCl — NaCl system in which the LiCl is mixed at a high concentration by means of an electrolytic cell made by horizontally arranging bi-polar electrodes formed of carbon (graphite) electrode plates with a proper clearance between them in a cell lined with a refractory material having a nitride base so that chlorine gas may be produced on the anode surface and molten metallic aluminum may be produced on the cathode surface. The special features of this process include the use of a special material high in the fireproofness and bath corrosion-resistance corrosion is used for the electrolytic cell container, the introduction of LiCl high in electric conductivity in the molten salt electrolytic bath composition to reduce the voltage drop of the bath, and a reduction in the distance between the electrodes to lower electric power consumption.

SUMMARY OF THE INVENTION

However, lithium chloride to be used in the electrolytic bath is an expensive industrial rommodity and, the electric current efficiency for an electrolytic bath of the $AlCl_3$ — LiCl — NaCl system is about 85% at most; thus, the extent of possible improvement (i.e. reduction), in electric power consumption is limited consequently it is desirable to develop a more industrially advantageous process for producing aluminum. As a result of making various researches particularly on the composition of an electrolytic bath, the present inventors have discovered that, when aluminum chloride is electrolyzed by using an electrolytic bath which contain, a relatively large amount of $CaCl_2$ or $MgCl_2$ in the bath of $AlCl_3$—NaCl system, aluminum can be produced at a very high current efficiency.

Therefore, the object of the present invention is to provide a process for producing aluminum by electrolyzing fused aluminum chloride together with the alkali metal halide to produce chlorine gas at the anode surface and molten aluminum at the cathode surface characterized in that the electrolytic bath is of a mixed composition of 2 to 15% by weight $AlCl_3$, 15 to 70% by weight $CaCl_2$ and/or $MgCl_2$ and 83 to 15% by weight NaCl.

According to the present invention, metallic aluminum can be produced by electrolyzing aluminum chloride at a high current efficiency reaching about 90 to nearly 100% and therefore the electric power needed for producing the aluminum can be greatly reduced.

The reason why a high current efficiency can be obtained when aluminum chloride is electrolyzed in molten salt electrolytic bath constituted as described above is not clear. However, from the fact that the greatest cause of loss in current efficiency in the electrolysis of aluminum chloride is said to be based on a reverse reaction in which a part of the aluminum deposited at the cathode surface dissolves in the electrolytic bath and reacts with the chlorine gas generated on the anode surface, it is presumed that the mixed molten salt of the $AlCl_3$ — $MgCl_2$ — NaCl, $AlCl_3$ — $CaCl_2$ — MgCl — NaCl or $AlCl_3$ — $CaCl_2$ — NaCl system having the above mentioned composition range has an action of effectively inhibiting the above mentioned reverse reaction from such stand points as the solubility of aluminum in the bath, the viscosity of the bath and the wettability of aluminum with the bath.

DETAILED DESCRIPTION OF THE INVENTION

In molten salt electrolytic bath systems as described above in the present invention, when the concentration of $AlCl_3$ in the bath exceeds 15% by weight, the electric conductivity will be so remarkably reduced and the vapor pressure of the bath will become so excessive as to cause the cell voltage to rise and cell operation to become unstable. Therefore, it is desirable to retain the $AlCl_3$ concentration below 15% by weight. If it is less than 2% by weight, the concentration will be so low that the electric power will be likely to be locally consumed for other purposes than the production of aluminum and it will be troublesome to control the supply of $AlCl_3$.

Further, in the bath of this system, the content of a total amount of 15 to 70% by weight $MgCl_2$ or $CaCl_2$ has an effect of elevating current efficiency during the electrolysis. When the total amount of $MgCl_2$ and/or $CaCl_2$ is less than the lower limit value, the current efficiency improving effect will be poor and, when the upper limit value is exceeded, the electric conductivity of the bath will be remarkably reduced. When the $CaCl_2$ concentration in the bath of the $AlCl_3$ — $CaCl_2$ — NaCl system or $AlCl_3$ — $MgCl_2$ — $CaCl_2$ — NaCl system exceeds 40% by weight, the bath will be separated into two layers and no normal electrolytic operation will be made. Therefore, it is desirable to keep the $CaCl_2$ concentration below it.

In the $AlCl_3$ — $MgCl_2$ — NaCl bath system, NaCl and $MgCl_2$ form together with $AlCl_3$ a uniform mixed bath over a comparatively wide composition range and therefore can be used very stably. The higher the weight ratio of $MgCl_2$ to NaCl, the higher the current efficiency in the electrolysis tends to be. Therefore, it is desirable that the NaCl and $MgCl_2$ be present in amounts sufficient to give a weight ratio of $MgCl_2$/NaCl of 1 or more to obtain 97% or higher current efficency. However, when the $MgCl_2$ content exceeds 70% by weight, the electric conductivity of the bath will drop remarkably. Therefore, it should be less than 70% by weight or preferably less than 65% by weight. If it is less than 15% by weight, the effect of increasing the current efficiency will be poor. Therefore, more than 15% by weight should be present.

In the $AlCl_3$ — $CaCl_2$ — $MgCl_2$ — NaCl bath system, it is desirable that the contents of $CaCl_2$, $MgCl_2$ and NaCl keep a weight ratio of $CaCl_2$ + $MgCl_2$/NaCl of 1 or more to obtain 97% or more of current efficiency.

The electrolyzing conditions under which stable operation of the electrolysis of aluminum chloride is made with the electrolytic bath of the present invention are different depending on the type and capacity of the cell but are generally of a bath temperature of 680 to 780° C., an electric current density of 0.5 to 2.0A/cm$^2$ and an electrode spacing distance of 10 to 25mm. When electrolysis conditions are selected within this range, the electrolytic production of aluminum will proceed continuously with a current efficiency of more than about 90%. Further, when the electrolytic bath of the present invention is used, the cathode collapsing phenomenon occasionally seen in this kind of electrolyzing process will not be caused.

Incidentally, in electrolyzing aluminum chloride according to the present invention, such horizontal multielectrodes as are known in the ALCOA process can be used in the electrolytic cell. However, generally, in this kind of electrolyzing process, the distance between the electrodes is so comparatively small (10~25mm) that it is desirable from the standpoint of increasing current efficiency to quickly remove the aluminum produced at the anode surface and prevent its reaction with the chlorine gas produced at the anode surface. As a result of investigating the electrodes from this viewpoint, it has been found that, when the electrodes are inclined, the produced aluminum will flow easily and removed itself from between the electrodes. The angle of inclination of the electrode plates from the horizontal plane should be less than 50 degrees or preferably 10 to 45 degrees. If the angle of inclination exceeds 50 degrees, the current efficiency will rather less.

Also, in the process of the present invention, it is advantageous to add a small amount of $BaCl_2$ to the electrolytic bath, because the addition of $BaCl_2$ in the amount of up to 10% of the total amount of the electrolytic bath functions to reduce interfacial tension of the aluminum metal bath so as to effectively promote the flow of the metal from the cathode surface, though it is not effective for improving current efficiency.

The present invention shall be explained more particularly by means of the following concrete examples.

EXAMPLE 1

29.6g of aluminum were obtained by continuing an electrolysis for 4.5 hours at an electrode spacing distance of 14mm, a bath temperature of 750° C., an electric current of 20A, a current density of 1A/cm$^2$ and a cell voltage of 3.30V using a mixed molten salt of the $AlCl_3$ — $MgCl_2$ — NaCl system composed of 8.3% by weight $AlCl_3$, 56.7% by weight $MgCl_2$ and 35.0% by weight NaCl as the electrolytic bath and using inclined graphite electrode plates (having an effective reaction surface of 80mm × 25mm) extending at an angle of 30 degrees to the horizontal within an electrolytic cell lined with a refractory material of alumina. The current efficiency at this time was 98%.

EXAMPLE 2

29.0g of aluminum were obtained by continuing an electrolysis for 4.5 hours at an electrode spacing distance of 14mm, a bath temperature of 750° C., an electric current of 20A, a current density of 1A/cm$^2$ and a cell voltage of 3.20V using a mixed molten salt of the $AlCl_3$ — $CaCl_2$ — NaCl system bath composed of 10.0% by weight $AlCl_3$, 38.4% by weight $CaCl_2$ and 51.6% by weight of NaCl as the electrolytic bath and using inclined graphite electrode plates (of an effective reaction surface making 80mm × 25mm) of an angle of 30 degrees with the horizontal within an electrolytic cell lined with a refractory material of alumina. The current efficiency at this time was 96%.

EXAMPLE 3

29.3g of aluminum were obtained by continuing an electrolysis for 4.5 hours at an electrode spacing distance of 14mm, a bath temperature of 750° C., an electric current of 20A, a current density of 1A/cm$^2$ and a cell voltage of 3.45V using a mixed molten salt of the $AlCl_3$ — $CaCl_2$ — $MgCl_2$ — NaCl system composed of 6.7% by weight of $AlCl_3$, 23.3% by weight $CaCl_2$, 42.0% by weight $MgCl_2$ and 28.0% by weight NaCl as an electrolytic bath and using inclined graphite electrode plates (of an effective reaction surface of 80mm × 25mm) of an angle of 30 degree with the horizontal within an electrolytic cell lined with a refractory material of alumina. The current efficiency at this time was 97%.

EXAMPLE 4

28.7g of aluminum were obtained by continuing an electrolysis for 4.5 hours under the same conditions as in Example 3 (except for a cell voltage of 3.23V) by using a mixed molten salt of the $AlCl_3$ — $CaCl_2$ — $MgCl_2$ — NaCl system having a composition of 11.0% by weight $AlCl_3$, 14.0% by weight $CaCl_2$, 24.0% by weight $MgCl_2$ and 51.0% by weight NaCl as the electrolytic bath. The current efficiency at this time was 95.0%.

EXAMPLE 5

27.6g of aluminum were obtained by continuing an electrolysis for 4 hours under the same conditions as in Example 4 using a mixed molten salt of the $AlCl_3$ — $MgCl_2$ — $BaCl_2$ — NaCl system having a composition of 14.0% by weight $AlCl_3$, 27.0% by weight $MgCl_2$, 8.0% by weight $BaCl_2$ and 51.0% by weight NaCl as an electrolytic bath. The current efficiency at this time 91.2%.

EXAMPLE 6

59.2g of aluminum were obtained by continuing an electrolysis for 4 hours at an electrode spacing distance of 14mm forming a bi-polar electrode between the cathode and anode electrodes, a bath temperature of 750° C., an electric current of 20A and a cell voltage of 6.5V using a mixed molten salt of the $AlCl_3$ — $MgCl_2$ — NaCl system composed of 9.5% by weight of $AlCl_3$, 54.5% by weight of $MgCl_2$ and 36.0% by weight of NaCl as the electrolytic both and using inclined graphite electrode plates (of an effective reaction surface of 80mm × 25mm) making an angle of 30 degrees with the horizontal within an electrolytic cell lined with a refractory material of alumina. The current efficiency at this time was 96.4%.

We claim:

1. In a process for electrolytically producing metallic aluminum by melting and electrolyzing aluminum chloride together with an alkali metal halide in a cell lined with a refractory material and containing graphite electrodes to produce chlorine gas at the anode surface and molten aluminum at the cathode surface, the improvement wherein the electrolytic bath of a mixed molten salt consisting essentially of 2 to 15% by weight of $AlCl_3$, 15 to 70% by weight of at least one chloride selected from the group consisting of $CaCl_2$ and $MgCl_2$, provided that the amount of $CaCl_2$ does not exceed 40% by weight, and 83 to 15% by weight NaCl.

2. The process for electrolytically producing metallic aluminum according to claim 1 wherein less than 10% by weight of $BaCl_2$ is added to said mixed salt bath.

3. The process for electrolytically producing metallic aluminum according to claim 2 wherein the $MgCl_2$/NaCl weight ratio is 1 or more.

4. The process for electrolytically producing metallic aluminum according to claim 1 wherein said electrolytic bath consists essentially of 2 to 15% by weight $AlCl_3$, 15 to 70% by weight $MgCl_2$ and 83 to 15% by weight NaCl.

5. The process for electrolytically producing metallic aluminum according to claim 4 wherein the weight ratio of $MgCl_2$ + $CaCl_2$)/NaCl is 1 or more.

6. The process for electrolytically producing metallic aluminum according to claim 1 wherein said electrolytic bath consists essentially of 2 to 15% by weight $AlCl_3$, 15 to 70% by weight of a mixture of $CaCl_2$ and $MgCl_2$ containing not more than 40% by weight of $CaCl_2$, and 83 to 15% by weight NaCl.

7. The process for electrolytically producing metallic aluminum according to claim 1 wherein said elecytrolytic bath consists essentially of 2 to 15% $AlCl_3$, 15 to 40% by weight $CaCl_2$ and 83 to 45% by weight NaCl.

8. The process for electrolytically producing metallic aluminum according to claim 1 wherein plate-shaped graphite electrodes are used for both cathode and anode and are arranged in parallel inclined relation so that the axes in the lengthwise direction of both of said electrodes make an angle of less than 50 degrees with the horizontal source.

9. The process for electrolytically producing metallic aluminum according to claim 8 wherein said angle of inclination is 10 to 45 degrees.

* * * * *